US012509973B2

(12) United States Patent
Sanchez et al.

(10) Patent No.: US 12,509,973 B2
(45) Date of Patent: Dec. 30, 2025

(54) ESP SHIELDING VIA TOE-DOMINANT SOLVENT INJECTION

(71) Applicant: CONOCOPHILLIPS COMPANY, Houston, TX (US)

(72) Inventors: Javier Sanchez, Houston, TX (US); Alex Filstein, Houston, TX (US); Mason Ogg, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 113 days.

(21) Appl. No.: 18/675,903

(22) Filed: May 28, 2024

(65) Prior Publication Data

US 2024/0401451 A1 Dec. 5, 2024

Related U.S. Application Data

(60) Provisional application No. 63/504,957, filed on May 30, 2023.

(51) Int. Cl.

| | |
|---|---|
| ***E21B 43/24*** | (2006.01) |
| ***E21B 43/12*** | (2006.01) |
| ***E21B 47/008*** | (2012.01) |
| ***E21B 47/07*** | (2012.01) |

(52) U.S. Cl.

CPC ..... *E21B 43/2408* (2013.01); *E21B 43/128* (2013.01); *E21B 47/008* (2020.05); *E21B 47/07* (2020.05)

(58) Field of Classification Search

CPC ..... E21B 43/24

See application file for complete search history.

(56) References Cited

U.S. PATENT DOCUMENTS

| | | | | |
|---|---|---|---|---|
| 4,344,485 | A | 8/1982 | Butler | |
| 10,287,864 | B2 | 5/2019 | Chen et al. | |
| 10,526,881 | B2 | 1/2020 | Chen et al. | |
| 10,995,596 | B2 | 5/2021 | Chen et al. | |
| 2012/0048546 | A1* | 3/2012 | Ndinemenu | E21B 43/24 166/272.3 |
| 2013/0175030 | A1 | 7/2013 | Ige et al. | |
| 2014/0216732 | A1* | 8/2014 | Stone | E21B 43/2406 166/250.15 |
| 2015/0354302 | A1* | 12/2015 | Watt | E21B 47/07 166/241.5 |
| 2016/0084254 | A1 | 3/2016 | Dowling | |
| 2018/0313197 | A1 | 11/2018 | Redman et al. | |
| 2021/0301813 | A1 | 9/2021 | Armacanqui et al. | |

OTHER PUBLICATIONS

International Search Report and Written Opinion for Application No. PCT/US2024/031271 dated Aug. 17, 2024.

* cited by examiner

*Primary Examiner* — William D Hutton, Jr.
*Assistant Examiner* — Avi T Skaist
(74) *Attorney, Agent, or Firm* — Boulware & Valoir PLLC

(57) ABSTRACT

A method for producing heavy oil using solvent injection without gas interference at the electric submersible pump (ESP), the method including completing the injection well with two or more injector tubings, at a heel and toe, and optionally therebetween. Ideally, when gas locking of the ESP is detected, the operator switches to toe dominant injections, mitigating the gas locking problem, and producing oil at a faster rate than possible with evenly distributed injections.

19 Claims, 10 Drawing Sheets

ESP SHIELDING VIA TOE-DOMINANT SOLVENT INJECTION

PRIOR RELATED APPLICATIONS

This application claims priority to U.S. Ser. No. 63/504,957, filed May 30, 2023 and incorporated by reference in its entirety for all purposes.

FEDERALLY SPONSORED RESEARCH STATEMENT

Not applicable.

FIELD OF THE INVENTION

The invention relates to petroleum production—in particular to methods for producing heavy oil and/or bitumen with steam and solvent in a manner so as to eliminate gas interference with an electric submersible pump (ESP). More particularly, it relates to a strategy for injecting solvent to varying positions along the well length, to minimize solvent short circuiting and gas locking of the pump, which otherwise reduces emulsion intake and therefore lower oil production rates.

BACKGROUND OF THE INVENTION

Production of heavy oil and bitumen from a subsurface reservoir can be quite challenging. The initial viscosity of the oil at reservoir temperature is often greater than five million centipoise (cP), and because of its thickness and immobility, cannot be pumped to the surface. Thus, it must be either mined from the surface or treated in situ to make it pumpable. Since only a relatively small percentage—about 3%—of bitumen and oil sand deposits (such as the Athabasca oils sands of Alberta, Canada) are recoverable through open-pit mining, the majority of heavy oils require some form of in situ treatment to mobilize the oil, such as heating the oil with steam by the means of heat conduction or thinning it with solvents by the means of convection.

Steam-assisted gravity drainage (SAGD) is an in-situ method of thinning oil with steam heat that was first introduced by Roger Butler in 1973 as a means of producing viscous oils and is now widely used for recovery of heavy and extra-heavy oil. Traditional SAGD uses two parallel horizontal wells (see FIG. 1). The lower production well is located at or near the bottom of the play, and the upper well is 4-5 meters above the production well.

In a pre-production stage, steam is injected into both wells to conductively heat the petroleum deposit between the wells until the two wells are in fluid communication. This stage—known as start-up—can take on the order of 3-6 months in a typical Athabasca oil sands reservoir. While steam injection is the most common method of start-up, there are other methods, and the operator is not limited to steam.

Once the wells are in fluid communication, the lower well is converted over to oil production by changing the completion from injection to production. During the SAGD stage, steam is injected only into the top horizontal well (injection well) and the heated oil and any condensed water are produced by gravity drainage to the lower horizontal well (production well). The heated oil and water emulsion is now pumpable, and is typically brought to the surface with a sucker rod pump or an electric submersible pump (ESP).

SAGD requires on-site steam generation and water treatment, translating into expensive surface facilities. SAGD is also very energy intensive, largely because the reservoir rock and fluids must be heated enough to mobilize the petroleum deposit, but heat is lost to overburden and underburden, to water and gas intervals, and to the non-productive rock. On average, a third of the energy is produced back with fluids in the reservoir, a third is lost to overburden and underburden, and a third is left behind in the reservoir after abandonment. These inefficiencies result in a steam-to-oil ratio (SOR) of 3.0 (vol/vol), and a 50-60% recovery factor of the original bitumen contacted by steam. That is for every barrel of oil produced, three barrels of water must be heated to make steam and only about half the oil can be produced. To compound these inefficiencies, heavy oil and bitumen are sold at significant discounts compared to oil product benchmarks, such as West Texas Intermediate (WTI) due to an additional dilution requirement in order to transport the otherwise viscous product.

All of these factors provide an exceedingly challenging economic environment for producing heavy oil. Thus, there have been many efforts to increase SAGD efficiency and/or reduce costs. This is especially true late in the life cycle of a SAGD well, when the SOR begins to increase, and the costs correspondingly increase with the increased steam usage.

One possible strategy is to replace or supplement steam with a solvent, which can be recycled, or a non-condensable gas (NCG), which helps to maintain pressure and may provide some degree of solvation. Many researchers are therefore looking for ways to optimize steam and/or solvent/NCG production methods in order to produce heavy oils and bitumen as cost effectively and efficiently as possible, and the patent literature is replete with variations on these ideas, including changing the well arrangement, changing solvents or combinations thereof, changing solvent to steam ratios, changing the timing, and the like.

While many patents call for solvent or gas injection in order to reduce the SOR of SAGD, one common problem with this solution is gas interference with the ESP. When solvent is being co-injected during SAGD, it is injected in the gaseous phase. If injected in liquid phase, that fluid will tend to drain by gravity towards the producing well without the opportunity to grow the chamber. Thus, gaseous injection is required for an economic and environmentally friendly recovery scheme where the least amount of solvent and steam is injected to grow the chamber.

Steam, as an example, is injected into the reservoir at 2.5 mPa above 240° C. This temperature allows the operator to avoid water injection. At the same pressure of 2.5 mPa, a solvent such as butane should be injected around 150° C. and solvent propane should be injected above 75° C. If the solvents are being injected at any condition residing on the left side of the vapor pressure curve (see FIG. 2 for the vapor pressure curve for methane, propane, butane, and acetylene) the injection will take place in liquid phase, which is detrimental to the recovery scheme.

However, as the well starts producing, gaseous solvent (known as "gas slugs") can be drawn into the fluid mix. Because ESP systems generate lift by pushing fluid through stages, when gas slugs enter the pump, it disrupts the flow of fluid to the surface. Artificial lift engineers have developed technologies over the years to reinforce the ESP's ability to handle gas production, including ESP gas separators, helicoaxial stages, and tapered pump configurations. Whenever possible, however, the operator's best chance to eliminate gas-related setbacks is to prevent gas from entering the pump altogether. Usually, this means injecting more steam to counteract the gas interference, the additional fluid protecting the pump by lifting the fluid levels. However, this solution increases the SOR, contributing to cost.

Thus, what is needed in the art are methods of mitigating gas interference with the ESP. The ideal method will not contribute to SOR, nor increase costs associated with additional completion or cumulative solvent injection rates. This invention meets one or more of these needs.

SUMMARY OF THE INVENTION

The invention generally relates to methods to decrease, if not eliminate, gas interference at the pump when injecting gas such as NCG or solvents, such as $CO_2$, $CH_4$, ethane, propane, butane, or mixtures thereof into a reservoir. Described simply, the method involves providing the injection well with both toe and heel tubings (and possibly one or more points therebetween), so that the heated solvent can preferentially be injected towards the toe and further away from the ESP. Customized allocation of solvent injected based on gas lock frequency events can be implemented once a threshold is met for increased gas lock events and reduced oil production rates, wherein the solvent can be allocated to be injected preferentially at the toe or toe and midway.

The invention includes any one or more of the following embodiment(s) in any combination(s) thereof.

A method for producing heavy oil without gas interference in an electric submersible pump (ESP), said method comprising:
a) providing a well-pair having a horizontal injection well parallel to and in fluid communication with a horizontal production well, said production well fitted with an ESP at a heel of said production well, said injection well above said production well and completed with a heel-injection tube that terminates at a heel of said injection well and a toe-injection tube that terminates at a toe said injection well;
b) injecting more solvent into said toe-injection tube than into said heel-injection tube, thereby minimizing gas interference with said ESP; and
c) producing oil from said production well, wherein higher oil production rate is realized in said method than in another method that injects equivalent solvent into said toe-injection tube and said heel-injection tube or in one continuous tubing (e.g., a single tubing having perforations along its length so that the injection is uniform along the length of tubing).

A method for producing heavy oil without gas interference in an electric submersible pump (ESP), said method comprising:
a) providing a well-pair having a horizontal injection well parallel to and in fluid communication with a horizontal production well having an ESP at a heel thereof, said injection well above said production well and completed with a heel-injection tube that terminates at a heel of said injection well and a toe-injection tube that terminates at a toe of said injection well;
b) co-injecting more steam and solvent into said toe-injection tube than into said heel-injection tube after gas locking is detected, thereby minimizing gas interference with said ESP; and
c) producing oil from said production well, wherein oil is produced at a faster rate in said method than in another method that injects equivalent solvent into said toe-injection tube and said heel-injection tube when gas locking is detected.

A method for producing oil without gas interference in an electric submersible pump (ESP), said method comprising:
a) providing a well-pair having a horizontal injection well parallel to and in fluid communication with a horizontal production well, said production well fitted with an electric submersible pump (ESP) at a heel of said production well, said injection well above said production well and completed with a heel-injection tube that terminates at a heel -continued of said injection well and a toe-injection tube that terminates at a toe of said injection well;
b) injecting steam and solvent or only solvent into said heel-injection tube and said toe-injection tube, and producing oil from said production well;
c) monitoring said ESP or an oil production rate or an oil temperature or well temperature to detect when gas interference is occurring in said ESP, and then switching to injecting more steam and solvent or just solvent into said toe-injection tube than into said heel-injection tube, thereby minimizing gas interference of said ESP; and producing oil from said production well, wherein oil is produced at a faster rate in said method than in another method that injects equivalent steam and solvent or only solvent into said toe-injection tube and said heel-injection tube after determining that gas interference is occurring An improved method of producing oil, said method involving injecting steam and solvent evenly along a well length and producing oil, the improvement comprising injecting solvent evenly along a well length and producing oil while simultaneously monitoring for gas interference with an ESP, then switching to toe-dominant steam injection after gas interference is detected, thereby producing oil at a faster rate than a method lacking said switching step.

An improved method of producing oil, said method involving injecting steam and solvent evenly along a length of a well and producing oil, the improvement comprising switching from even injection to toe-dominant steam and solvent injection wherein more solvent is injected at a toe of said well than at a heel of said well after gas interference is detected, thereby producing oil at a faster rate than a method lacking said switching step.

An improved method of producing oil, said method involving injecting steam and solvent evenly along a well length and producing oil, the improvement comprising injecting steam and solvent evenly along a well length and producing oil and simultaneously monitoring for gas interference with an ESP, then switching to toe-dominant steam and solvent injection after gas interference is detected, thereby producing oil at a faster rate than a method lacking said switching step.

Any method herein described, said injection well completed with a mid-injection tube midway between said toe-injection tube and said heel-injection tube wherein said solvent is injected more into said toe-injection tube than said mid-injection tube, and more into said mid-injection tube than said heel-injection tube.

Any method herein described, wherein said injecting step b) is co-injecting steam and solvent.

Any method herein described, wherein said solvent is a C1-C8 solvent or a non-condensable gas (NCG).

Any method herein described, wherein said solvent is a C1-C5 solvent.

Any method herein described, wherein said solvent is a C1-C4 solvent or C1-C2 solvent.

Any method herein described, wherein said solvent is methane.

Any method herein described, wherein said solvent is a non-condensable gas (NCG) such as methane, ethane and/or superheated non-condensing gas at elevated reservoir temperature solvents such as propane and butane.

Any method herein described, wherein said solvent is a NCG selected from carbon dioxide ($CO_2$), carbon monoxide (CO), nitrogen ($N_2$), methane, ethane, ethylene, nitrogen oxides ($NO_x$), sulfur oxides ($SO_x$), flue gas, or combinations thereof.

Any method herein described, said injection well completed with a mid-injection tube midway between said toe-injection tube and said heel-injection tube wherein said solvent is injected more into said toe-injection tube than said mid-injection tube, and more into said mid-injection tube than said heel-injection tube.

Any method herein described, wherein said solvent is an NCG or a C1-C8 solvent, or preferably a C1-C5 solvent, or most preferred a C1-C4 or C1-C2 solvent or an NCG.

Any method herein described, wherein said solvent injection is at least 60% into said toe-injection tube.

Any method herein described, wherein said solvent injection is at least 75% into said toe-injection tube.

Any method herein described, wherein said solvent injection is at least 80% into said toe-injection tube.

Any method herein described, wherein said solvent injection is at least 90% into said toe-injection tube.

Any method herein described, wherein solvent is co-injected with steam.

Any method herein described, wherein solvent is co-injected with steam

-continued and steam injection is evenly distributed between said toe-injection tube and said heel-injection tube. Alternatively, steam injection can also be toe-dominant, but not necessarily at the same level of toe dominance as the solvent.

Any method herein described, wherein said solvent is an NCG or a C1-C8 solvent, or preferably a C1-C5 solvent, or most preferred a C1-C4 or C1-C2 solvent or a NCG.

Any method herein described, wherein said solvent injection is at least 60%, 70, 80 or 90% into said toe-injection tube after gas locking is detected.

Any method herein described, wherein a toe/heel injection ratio is 2:1, 3:1, 4:1 or 5:1.

As used herein a "toe-dominant" solvent injection means that more solvent is injected at the toe than at the heel. Steam may be co-injected therewith and steam levels need not equate to solvent levels. Thus, steam can be evenly injected along well length and solvent toe-dominant, or steam can also be toe-dominant at the same or different levels than the solvent.

The "toe" of a well is its termination point in the reservoir. The "heel" is where the well turns from horizontal to vertical. The ESP is typically at or near the heel of a producer.

An "ESP" is an electric downhole pump used in heavy oil production that is designed with vane and fin configurations to accommodate frictional losses and pump inefficiencies caused by heavy oil viscosity. It is a multistage centrifugal type pump that accomplishes fluid lift by imparting kinetic energy to the fluid by centrifugal force and then converting that to a potential energy in the form of pressure.

By injecting "steam only," we mean no NCG or solvent is intentionally injected thereinto. Minor contaminants to the steam are excluded from consideration, however, and include any contaminants in the water used to make the steam, entrained gases, and the like. Likewise, co-injecting only steam and solvent means that other fluids are not intentionally added.

"Solvent" herein can include hydrocarbon solvents and non-condensable gases, or anything else injected in the gaseous phase that is prone to gas locking the ESP.

"Hydrocarbon solvent" refers to a chemical consisting of carbon and hydrogen atoms which is added to oil to increase its fluidity and/or decrease viscosity. A hydrocarbon solvent, for example, can be added to a fossil fuel deposit, such as a heavy oil deposit or bitumen, to partially or completely dissolve the material, thereby lowering its viscosity and allowing recovery. The hydrocarbon solvent can have, for example, 1 to 8 carbon atoms ($C_1$-$C_8$), 1-4 carbons ($C_1$-$C_4$), or preferably 1-2 ($C_1$-$C_2$) or 3-4 carbons ($C_3$-$C_4$) herein.

"Non-condensable gases" or "NCGs" are gases from chemical or petroleum processing units (such as distillation columns or steam ejectors) that are not easily condensed by cooling at reservoir conditions. Examples of suitable NCGs for solvent assisted recovery processes include, but are not limited to, carbon dioxide ($CO_2$), carbon monoxide (CO), nitrogen ($N_2$), methane, ethane, ethylene, nitrogen oxides (NOx), sulfur oxides ($SO_x$), flue gas, and the like, or combinations thereof. $CO_2$ maybe preferred as a means of sequestering carbon in the reservoir, methane may be preferred where readily available onsite or nearby, or flue gas from local engine use is another preferred option, especially flue gas from a direct steam generator.

"Flue gas" or "combustion gas" refers to an exhaust gas from a combustion process that typically exits to the atmosphere via a pipe or channel. Flue gas typically comprises nitrogen, $CO_2$, water vapor, oxygen, CO, nitrogen oxides (NOx) and sulfur oxides ($SO_x$). The combustion gases can be obtained by direct steam generation (DSG), reducing the steam-oil ratio and improving economic recovery.

"Formation" or "reservoir" as used herein refers to a geological structure, that includes one or more hydrocarbon-containing layers, possibly one or more non-hydrocarbon layers, an overburden and/or an underburden. The hydrocarbon layers can contain non-hydrocarbon material as well as hydrocarbon material. The overburden and underburden can contain one or more different types of impermeable materials, for example rock, shale, mudstone wet carbonate, or tight carbonate.

"Petroleum deposit" or "play" refers to an assemblage of hydrocarbons in a geological formation. The petroleum deposit can comprise light and heavy crude oils, natural gas, and bitumen. Of particular interest for the method described herein are petroleum deposits that are primarily heavy oil and bitumen.

"Heavy oil" as used herein is intended to include heavy, extra heavy and bitumen hydrocarbons. A heavy crude is in the 15-25 API range. Anything below 15 API would be considered an extra-heavy crude.

"Steam-assisted gravity drainage" or "SAGD" refers to an in-situ recovery method which uses steam and gravity drainage to produce oil from a traditional parallel horizontal well-pair with about 4-5 meters vertical separation and minimal lateral separation, and generally as described by Butler in U.S. Pat. No. 4,314,485. Such a well-pair may be called a "gravity drainage well-pair" or "SAGD well-pair" and there are variations on the arrangement of such well-pairs beyond the traditional SAGD well-pair, any of which may be used in the invention.

A "SAGD well-pair" or a "well-pair" refers to traditional horizontal parallel wells where the producer is low in the play and the injector is usually 4-5 meters above it. Other wells arrangements are possible in SAGD variants, however. Well-pairs are typically provided in an "array" to cover a play, and infill wells may be added between well-pairs later in the lifecycle of a producing well-pair.

Generally speaking, an injector in a well-pair is roughly "over" the producer, but some leeway in placement is typical as perfect control of drilling is difficult. Further, in some SAGD variants, their placement may vary.

"SAGD variants" includes all SAGD related or modified processes such as steam-assisted gravity push (SAGP), single-well SAGD, expanding solvent-SAGD (ES-SAGD), cross well SAGD (X-SAGD), varying well placement methods, and the like, as well as the original SAGD method, so long as both steam heating and gravity drainage are employed as the dominant driver of production.

In steam-assisted gravity push or "SAGP" the SAGD process be modified by injecting an NCG, such as natural gas, with the steam. Gas accumulates in the chamber above the injector, lowers the temperature there and provides some insulating effect. In addition, the gas helps to maintain pressure and reduce the SOR.

In expanding solvent-SAGD or "ES-SAGD" (also known as solvent assisted SAGD or SA-SAGD), a hydrocarbon additive at low concentration (1-5 vol % solvent) is co-injected with steam in a gravity-dominated process, similar to the SAGD process. The hydrocarbon additive is selected in such a way that it would evaporate and condense at the same conditions as the water phase.

Rich Solvent-SAGD or "RS-SAGD" is similar to ES-SAGD but the solvent content is >60 vol %.

Vapor Assisted Petroleum Extraction or "VAPEX" is a non-thermal vapor extraction (VAPEX) closely related to SAGD. However, in the VAPEX process the steam chamber is replaced with a chamber containing light hydrocarbon vapors close to the dew point at the reservoir pressure. The injected solvent vapor expands and dilutes the heavy oil by contact, which then drains by gravity to the lower horizontal production well to be produced.

The methods used herein can be applied to any oil production method that includes solvent/NCG injection or co-injection. Furthermore, although we tested the concept with steam/solvent co-injections, the same principles are predicted apply to gaseous solvent-only injections.

"Injection well" or "injector" refers to a well that is fitted (aka completed) for injection, and allows fluid injection into a reservoir. In a producing well-pair, it is typically 4-5 meters over a production well in a play, but may be closer in a thin play or in certain specialized well arrangements.

"Production well" or "producer" refers to a well that is fitted for production and is in and close to the bottom of a play and from which a produced fluid, such as heated heavy oil, is recovered from a geological formation. In SAGD and other gravity drainage processes, the well may be initially fitted for injection, then refitted for production once start-up is complete.

An "infill well" is a well low in the play situated between a conventional horizontal well-pair, and serves to catch oil trapped between the teardrop shaped steam/vapor chambers. These are usually drilled after the array of well-pairs have been produced to capture wedge oil that would otherwise be lost.

Although we discuss one or two horizontal well-pairs herein, it is understood that there may be an array of well-pairs covering a play, and that wells may also have multilateral wells branching off a mother well, or infill wells, as needed to effectively drain a play.

A "multilateral well" refers to a well, which is one of a plurality of horizontal branches, or "laterals", from a mother wellbore. These branch off an existing well, called the "mother" well, and do not reach the surface or have their own well pad. An array of multilaterals off a single mother wellbore may be called a "fishbone."

"Steam chamber", "vapor chamber" or "steam vapor chamber" refers to the pocket or chamber of gas and vapor formed in a geological formation by a SAGD, ES-SAGD, SAGP, VAPEX and variant processes.

"Production" refers to extraction of petroleum from a petroleum deposit or hydrocarbon-containing layer within a geologic formation.

By "providing" a well or a well-pair we do not necessarily imply de novo drilling of wells, as it is possible to perform the inventive method in existing wells, though they may need to be refitted with dual or triple injection tubing.

"Start-up" refers to the process of putting two wells in a gravity-drainage well-pair into fluid communication and is a distinctive phase in a well-pair's lifespan. This is frequently done by injecting steam into both wells, but other methods are possible, including electric, RF or EM heating of wells, solvent-assisted start-up, dilation start-up, combustion-based methods, and the like, as well as combinations thereof.

"Wind-down" is another distinct phase in a well's producing life wherein production is slowed, and measures are taken, for example, to recover solvent from the reservoir. Wind-down is initiated when oil production is no longer economical, and thus may vary depending on oil prices. However, wind-down is typically initiated when the oil recovery factor reaches a specified threshold or if the SOR increases to high levels where steam could be redeployed elsewhere to operate at lower SOR conditions. When wind-down is complete, the well is shut-in, although it may be opened again when either new technology is developed or when the price of crude oil increases sufficiently.

The use of the word "a" or "an" when used in conjunction with the term "comprising" in the claims or the specification means one or more than one, unless the context dictates otherwise. The use of the term "or" in the claims is used to mean "and/or" unless explicitly indicated to refer to alternatives only or if the alternatives are mutually exclusive.

The term "about" means the stated value plus or minus the margin of error of measurement or plus or minus 10% if no method of measurement is indicated.

The terms "comprise", "have", "include" and "contain" (and their variants) are open-ended linking verbs and allow the addition of other elements when used in a claim. The phrase "consisting of" is closed, and excludes all additional elements. The phrase "consisting essentially of" excludes additional material elements, but allows the inclusions of non-material elements that do not substantially change the nature of the invention, such as varying well arrangements, varying completion parameters, inclusion of additives in the injection fluids, and the like. Any claim or claim element introduced with the open transition term "comprising," may also be narrowed to use the phrases "consisting essentially of" or "consisting of," and vice versa. However, the entirety of claim language is not repeated verbatim in the interest of brevity herein.

The following abbreviations or definitions are used herein:

| ABBREVIATION | TERM |
|---|---|
| bbl/day | billion barrels/day |
| BHP | Bottom hole pressure |
| BPD | barrels per day |
| COP | Cumulative oil production |
| cP | Centipoise |
| CSI | Cyclic solvent injection, like CSS but with a solvent instead of steam |
| CSS | Cyclic steam injection, aka huff and puff |
| CSOR | Cumulative SOR |
| CWE | cold water equivalent |
| DTS | Distributed Temperature Sensing |
| ESP | Electric submersible pump |
| FB | Fishbone. A series of multilateral well segments that trunk or branch off a main horizontal well. The name is given because of the top view that resembles the ribs of a fish skeleton emerging from the backbone. |
| GHG | Greenhouse gases |
| GOR | Gas-to-oil ratio |
| MPa | Megapascals |
| NCG | Non-condensable gas. Includes methane, ethane, ethylene, $CO_2$, CO, sulfur oxide, ammonia, hydrogen sulfide, hydrogen, flue gas, nitrogen. |
| OIP | Oil in place. Not to be confused with original oil-in-place or OOIP, OIP is a term that refers to the total oil content of an oil reservoir. As this quantity cannot be measured directly, it has to be estimated from other parameters measured prior to drilling or after production has begun. |
| RF | Recovery factor. The recovered amount of hydrocarbon initially in place, normally expressed as a percentage. |
| RTP | Reservoir Temperature and Pressure |
| SCTR | Sector |
| SOR | Steam-to-oil ratio. A parameter used to monitor the efficiency of oil production processes based on steam injection. It measures the volume of steam (expressed as wet water equivalent) required to produce one unit volume of oil. Typical values |

-continued

| ABBREVIATION | TERM |
|---|---|
| | of SOR for cyclic steam stimulation are in the range of three to eight, while typical SOR values for steam assisted gravity drainage are in the range of two to five. The lower the SOR, the more efficiently the steam is utilized and the lower the associated fuel costs. |
| SW-SAGD | Single well SAGD |
| SW-XSAGD | Single well cross SAGD |
| T/D | Tonnes per day, A tonne is a metric ton (1,000 kg) |
| VAPEX | Vapor extraction |
| XSAGD | Cross well SAGD |

The worst gas locking event can be seen in Box A, impacting oil production as the ESP slows down significantly resulting in increased subcool and slower oil production rates. The last 10 days on the chart are shown in Box B, where more steady temperatures are observed due to reallocation of the solvent/steam co-injection to the toe string. This solution as described herein, restored the temperature of the produced fluid, decreased the subcool and resulted in increased oil production rates.

Figure 6A:
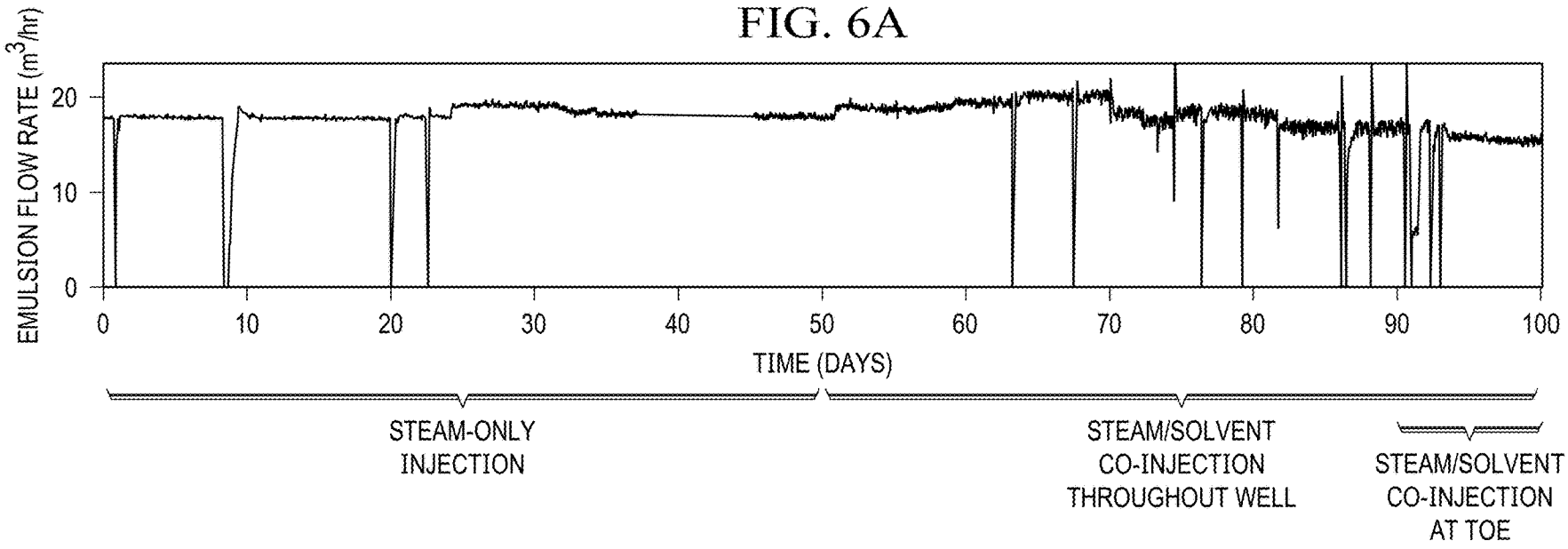
FIG. 6A shows normal emulsion flow rates with the Y axis being emulsion flow rate in $m^3$/hr and the x axis being 100 days of time, during which the first 50 days is steam injection only, and the next 40 is steam-plus-solvent (herein butane) co-injection and the final 10 days implementing the toe dominant solvent injection. The impact of gas locking events occurring at the pump can be seen during the steam-plus-solvent injection phase (see numerous spikes). Reallocation of the solvent and/or steam injection towards the toe results in more stable emulsion flow produced with minimal gas lock events at the pump as shown in the final 10 days of production.
Figure 6B:
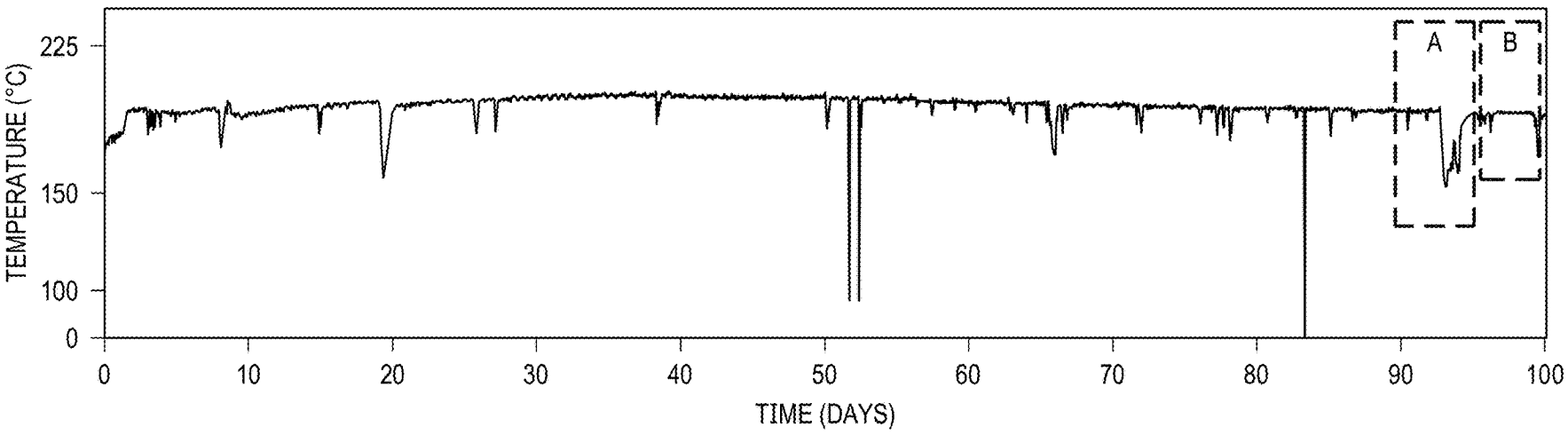
FIG. 6B shows temperature in ° C. versus the same 100 days of time. The graph shows temperature measured along the Distributed Temperature Sensing (DTS) tool at the producing well in ° C. Correlatively to the emulsion flow rates from FIG. 6A, one can observe the continuously declining yet steady temperatures during the SAGD phase and the erratic measurements during the evenly distributed steam/solvent co-injection phase caused by frequent gas locking.
Figure 7:
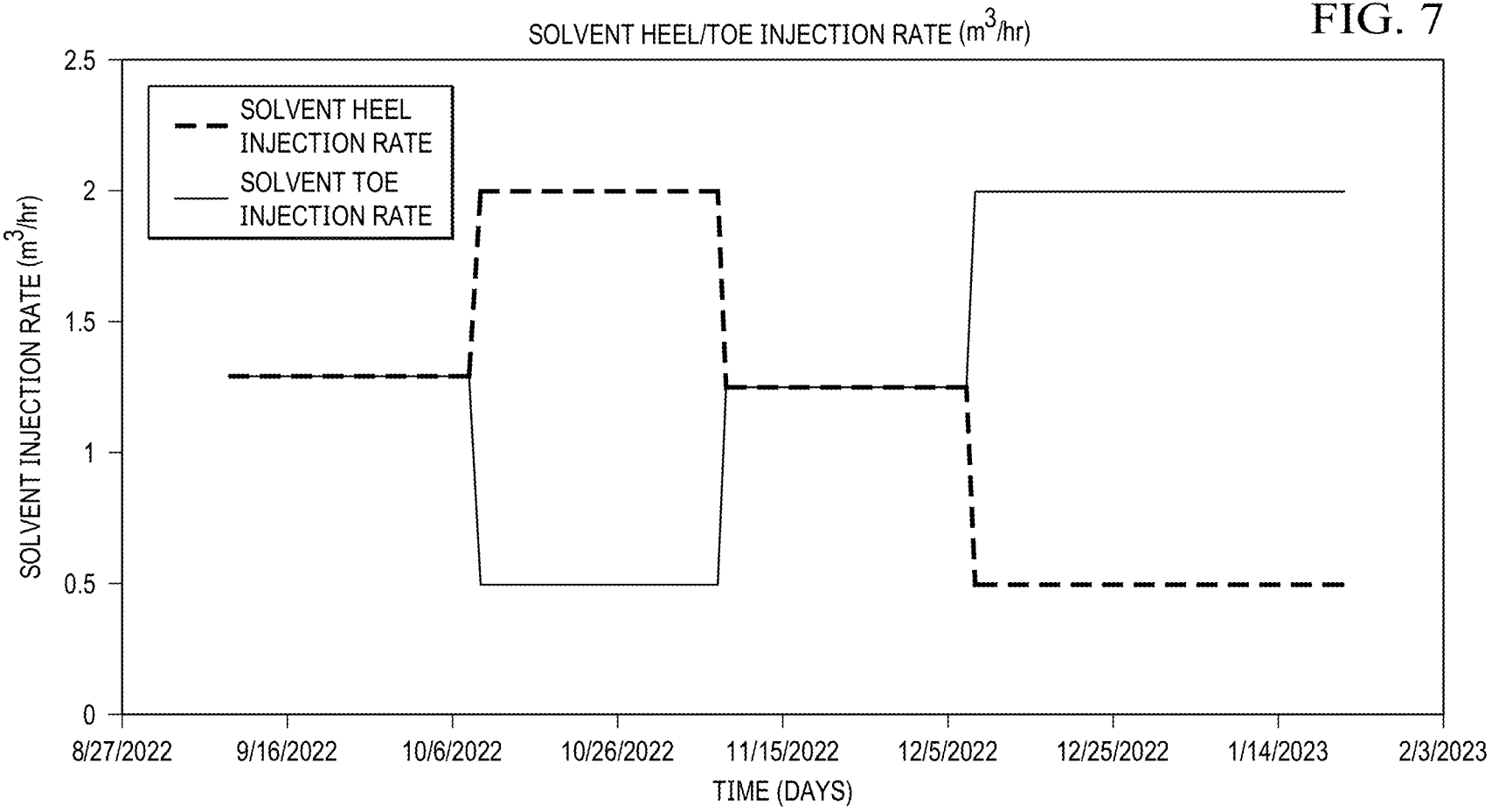

FIG. 7 shows two solvent heel and toe injection patterns. The Y axis is solvent flow injection rate in $m^3$/hr and the x axis is time in days. Early on we have heel-dominant and later toe-dominant solvent injection. Although not shown, our studies have shown that heel-dominated injection worsens pump locking and that the problem is significantly mitigated by reallocating solvent to toe dominant (see FIG. 6). Further modeling will indicate which precise amounts should be allocated to the toe and possibly mid-tubing based on reservoir geology.

DESCRIPTION OF THE INVENTION

The invention is a method of avoiding gas interference at the pump for any solvent injection based methods of producing heavy oil, including VAPEX, ES-SAGD, SAGP, Warm Applied Solvent Process (WASP), and any of the many variants thereof whenever a solvent, NCG, and/or steam is injected in gaseous form to produce heavy oil.

Figure 1:
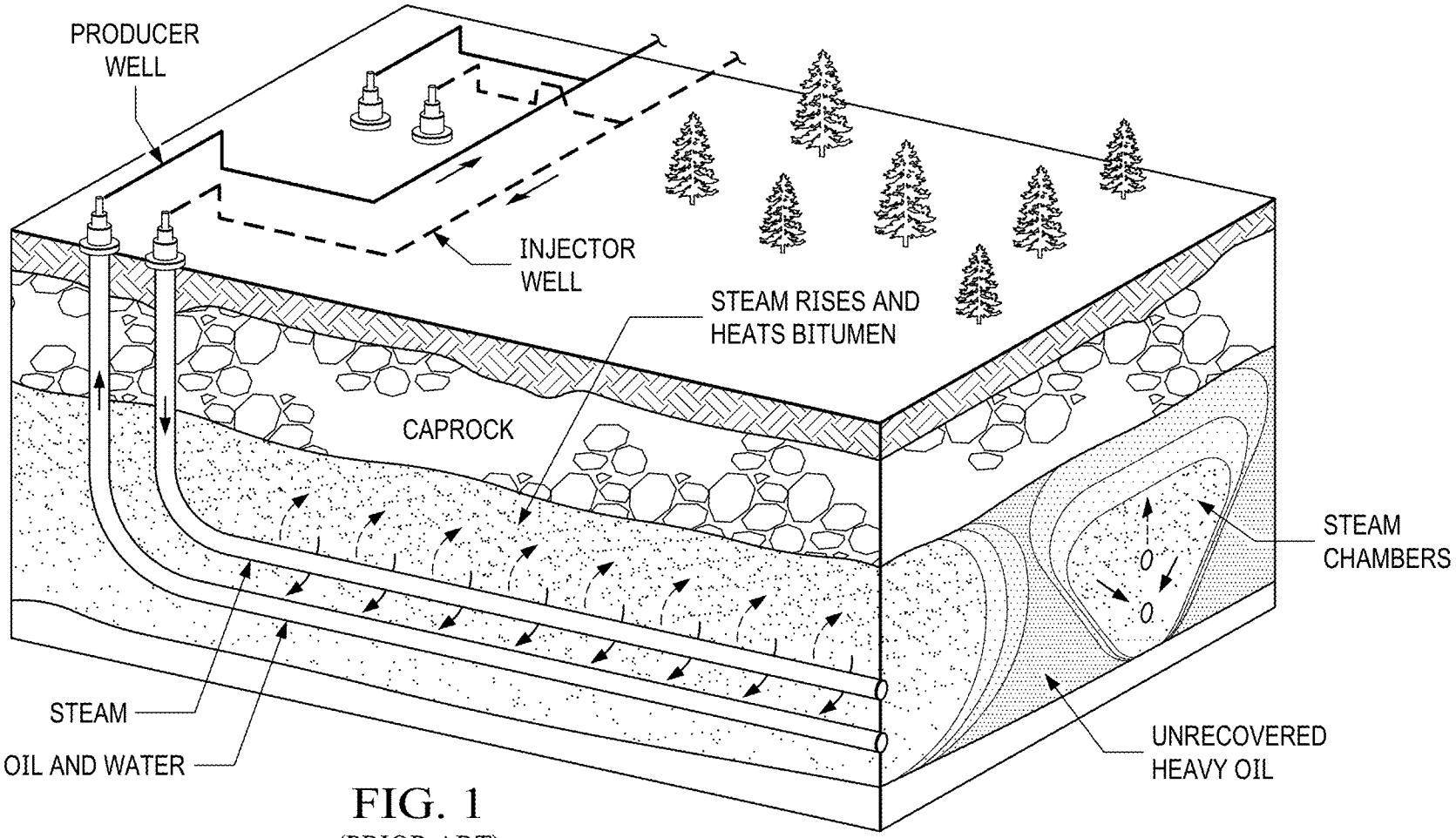
FIG. 1 (PRIOR ART)
FIG. 1 (Prior Art) depicts a conventional SAGD well-pair in an oil sand formation.
Figure 2:
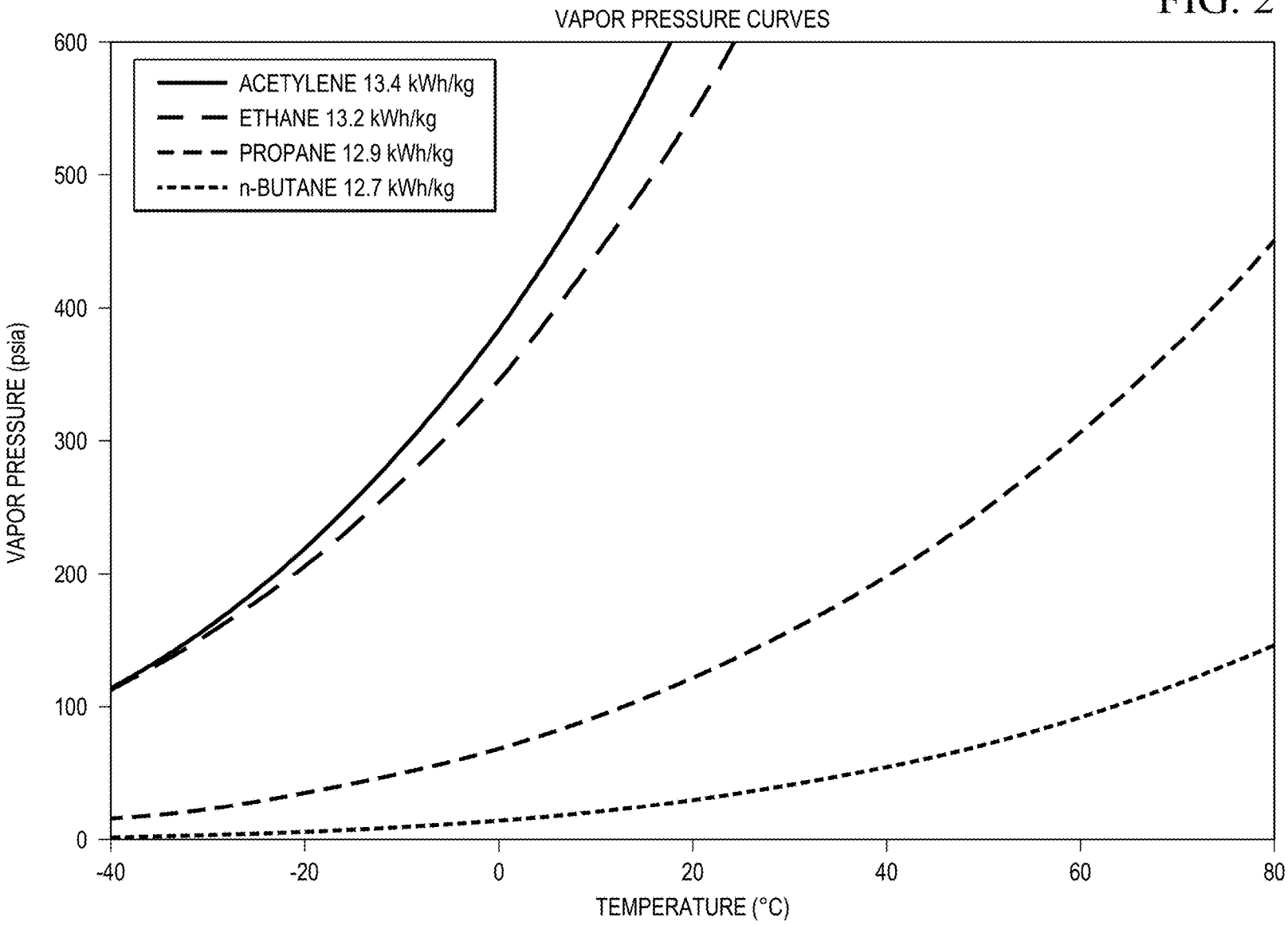
FIG. 2 (Prior Art) shows the vapor pressure curves for certain solvents.
Figure 3:
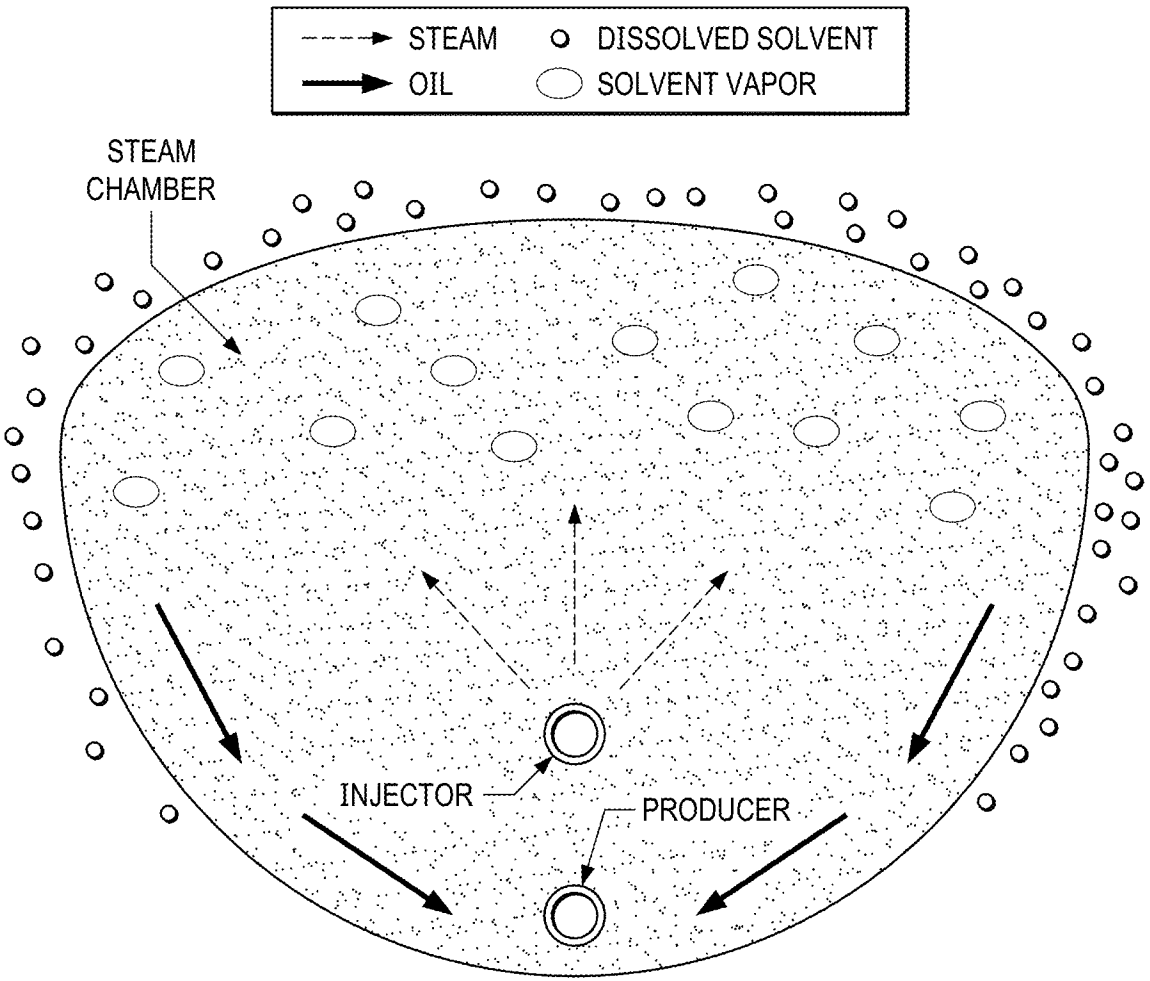
FIG. 3 (Prior Art) depicts the solvent vapor injection to a steam chamber, including some amount of solvent dissolved in the oil, which may bubble out, and the existence of solvent vapor in the steam chamber. This figure shows SAGD plus solvent injection and solvent solubility on the sides of the steam chamber. The illustrated "gas pockets" provide a representation that the gas spreads in the chamber and pressurizes the reservoir, the smaller dots represent solvent dissolving on the "outskirts" of the chamber.
Figure 4:
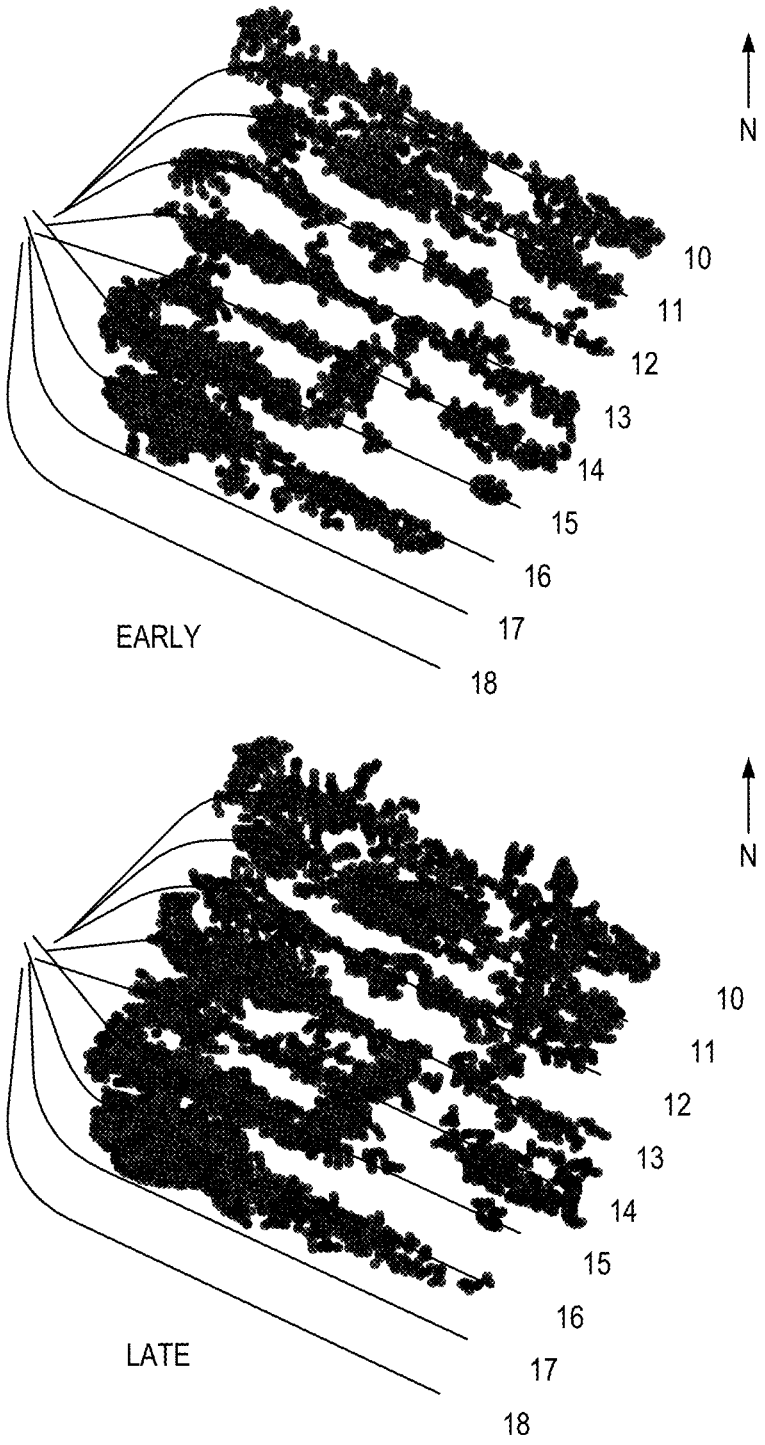
FIG. 4 shows a seismic map of even heel and toe co-injection at two different times (early on the left and later on the right). This map confirms that often the steam or steam solvent development is not uniform over time and depends significantly on the geology of the play. Thus, different well pairs could see drastically different solvent injection strategies and solvent allocation between the toe string and the heel string. Hence, it is most beneficial to track production rates or temperature as shown herein, and switch to toe-dominant injection after gas locking has begun to present problems in a particular well.

The challenge in any solvent injection process of producing oil is how to ensure that the impact on the ESP is minimal. The seismic graphs in FIG. 4 show that the steam chamber development varies significantly from well to well. As an example, the majority of steam chamber development in well-pair 16 occurred at the heel. Same could be said about well-pair 13 steam chamber development. Chambers in well-pairs 11 and 12 seem to merge at the toe and further expand relative to the initially mentioned chambers. When the chambers develop more closely to the heel, it is expected that the path towards the ESP is much hotter and thus easier for any gas that will be co-injected to reach the ESP and cause pump interference or gas locking.

Figure 5A:
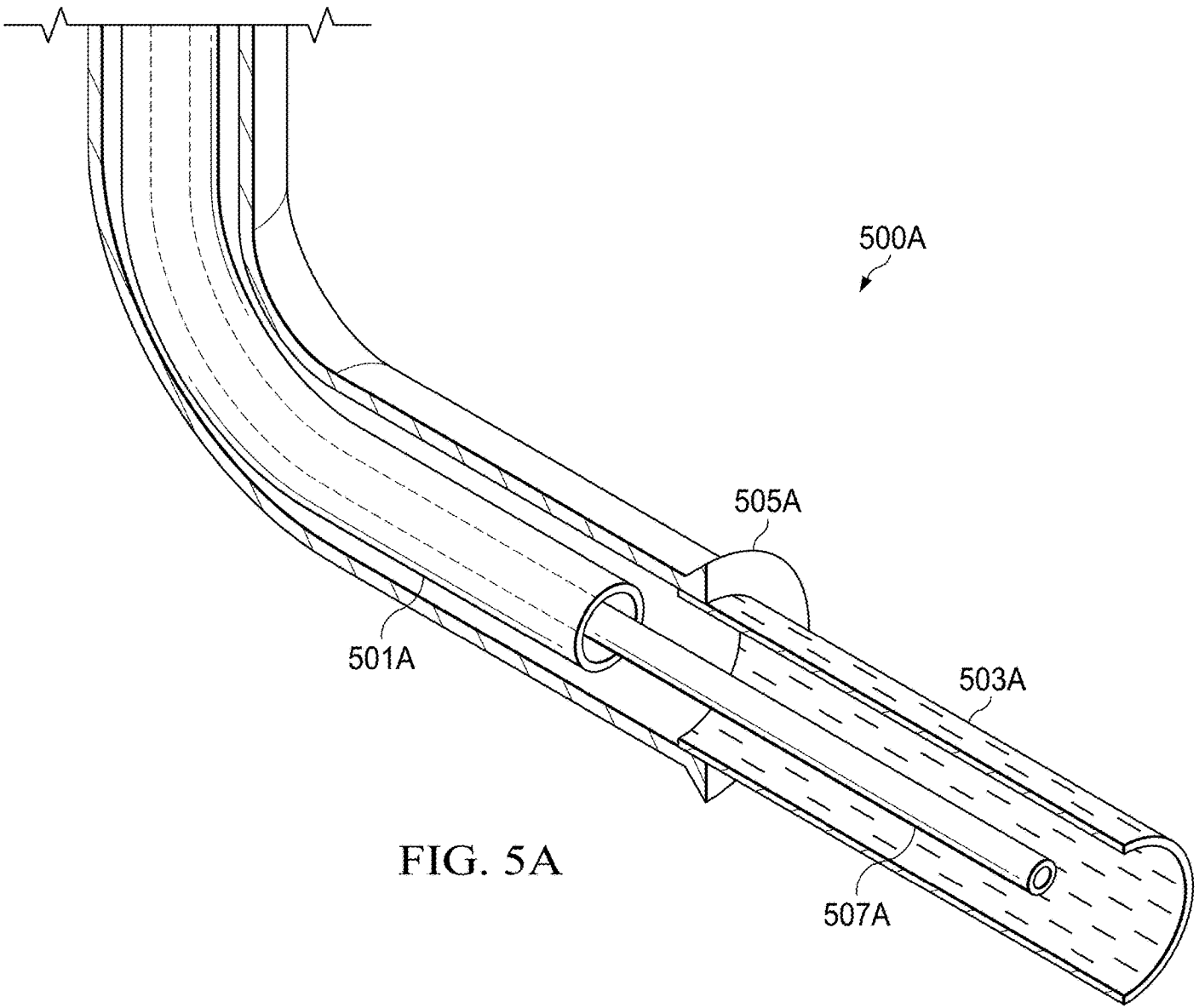
FIG. 5A-B show an inventive injector completion, wherein in FIG. 5A we see nested short and long tubes and in 5B they are side-by-side.
Figure 5B:
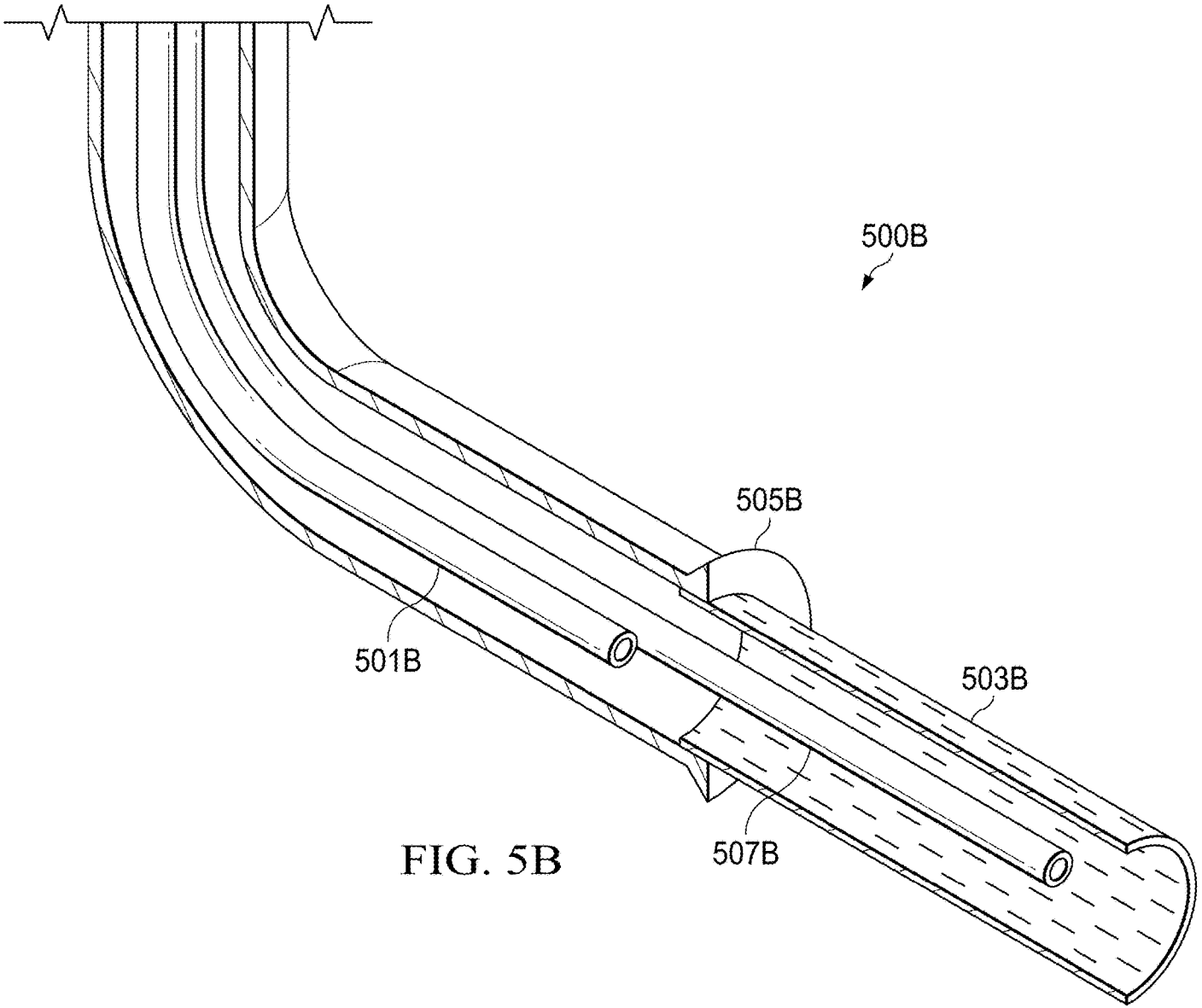
Figure 5C:
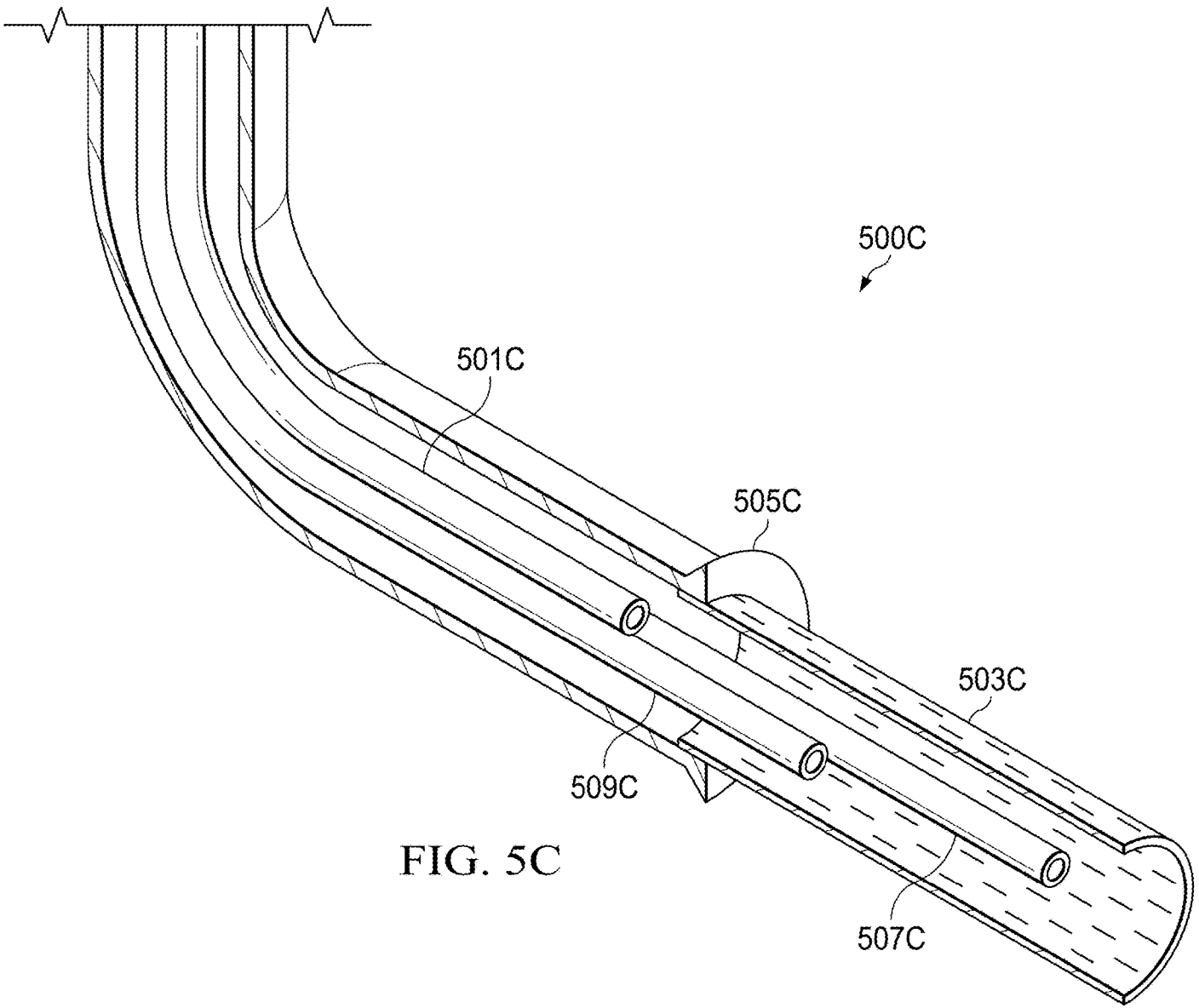
FIG. 5C shows three side-by-side tubings, one ending midway between the toe and heel tubings.

To mitigate this problem, we provide an injection completion 500A-C with at least 2 injection tubings, as shown in FIG. 5A-C. In FIG. 5A the injection tubings are nested, providing injection tubing at or near the heel 501A and at the toe 507A. Also seen are the slotted liners 503A-C, and the lining hangers 505A-C. The ratio of toe/heel injection is controlled by valving at the surface.

In FIG. 5B, the dual tubing is side-by side, and the numbers the same, but ending with B, and FIG. 5C includes a third tubing 509C that ends mid-way, providing even finer control over the injection profile.

With this type of injection completion, we can easily inject more steam/solvent at the toe than at the heel, thus obviating the gas locking problem. Ideally, the switch will be implemented when needed, as indicated by one or more indicators showing that gas locking is becoming problematic.

The graph in FIG. 6A shows 100 days of emulsion flow rate via an ESP. For the first 50 days, steam-only is being injected, and the flow is reasonably stable in the producer. This makes sense, as minimal steam short-circuiting is taking place and there is no solvent. The steam vapor is being injected and condensed steam in the form of water is being produced together with oil via the ESP and there is very little gas interference.

The following 50 days shows a steam-solvent co-injection scheme. The steam injection rate in this case was 100 T/d and the solvent injection rate was 30 T/d, and the co-injection profile was 50/50 vol % between the short (heel) and long (toe) tubings (e.g., even injection). Here there was significant reduction in the associated pump speed and less oil and water emulsion being produced. The flow rate also went to zero at times (see spikes), in order to build the required liquid level "to fight" gaseous solvent short-circuiting towards the ESP.

In FIG. 6B we see the producer temperature profile over the same time period. The temperature is reasonably stable during the first 50 day of steam-only injection. When we switch to steam-plus-solvent co-injection at 50 days, the system cools as expected, plus the data becomes very noisy as the pump is trying to stabilize. Extreme fluctuations are observed as the gaseous solvent migrates towards the ESP pump causing temperature swings.

We mitigated the gas interference by injecting an additional 50 T/d of steam to create more liquid level on top of the producing well to limit gas short-circuiting and limit gas locking events (data not shown). Although addressing gas interference, this solution resulted in an increased SOR, which is not advantageous to the recovery scheme when it comes to reducing emissions. In addition, the added steam could have been injected elsewhere to produce further oil and yield higher returns.

A better alternative solution to solve this problem is proposed in this disclosure by solvent portioning and customized reallocation towards the toe string on the solvent injection wt. % basis. This is shown in the last 10 days of FIGS. 6A and 6B, and both production rate and temperature even out with toe dominant injection, which showcases the representative solvent injection rates at the heel and toe strings. The steam portioning was 50/50 during that timeframe and the solvent about 3-4:1 toe:heel.

FIG. 7 shows the solvent heel and toe injection rates. The Y axis is solvent flow injection rate in $m^3$/hr and the x axis is time in days. In the first half we see even injection followed by a period of heel-dominant injection. We modelled 2 $m^3$/hour steam-solvent co-injection rate at the heel and 0.5 $m^3$/hour at the toe (1/4 toe/heel ratio). In this experiment, we observed that the increase in solvent injection at the heel area, which is closer to the ESP, resulted in more gaseous solvent migration towards the ESP similar to the displayed temperature response in FIG. 6A. Thus, allocation of more solvent in the heel area confirmed more gas interference. When the mitigation method described herein was implemented to provide toe-dominant injection, more solvent was allocated at the toe in a 4/1 ratio toe/heel, less interference was seen at the pump as mitigated in FIG. 6A, where more steady oil production rates are calculated.

Thus, when gas locking becomes a problem, the injection strategy should be designed accordingly to limit gaseous solvent migration to the ESP by reducing the amount of solvent injected to the heel and increasing the solvent co-injection to the toe. An increase of solvent towards the toe could be required to maintain the pressure in the reservoir and continuing steam-solvent chamber development. The extra solvent allocated towards the toe will travel longer to reach the ESP and in the process more likely condense into the oleic phase, thereby limiting gas interference with the ESP function.

Therefore, the inventive method provides solvent co-injection mainly or only to the long string aka toe injection. The solvent will be able to further advance toe chamber development and migrate towards the ESP as the mid-section is being further developed and oil is being produced.

Preferably, the timing to invoke higher injection of the solvent at the toe will depend on the frequency of the gas short-circuiting events, as seen in FIG. 6A. Ideally during the gas short-circuiting events toe/heel injection ratios will be 100% toe, or 80/20 toe/heel (4:1), 60/40 (3:2) toe/heel or any ratio where >50% of the co-injection is at the toe. If a third injection point is provided mid-well, then the ratios might be 80/20/0% toe/mid/heel, or 60/30/10 toe/mid/heel, 50/50/0 toe/mid/heel, or any ratio where at least 50% of the co-injection is at the toe.

In addition to toe-dominant injections to limit gas locking, the pressure could also be higher at the toe, as the pressure drop at the heel will help avoid gas locking. For example, if 50/20 $m^3$/d of steam/solvent is injected via the toe string and the same via the heel string, and gas locking begins to occur, an operator could decide to allocate 30/30 steam/solvent $m^3$/d to be injected via the toe string and 30/10 steam/solvent $m^3$/d to be injected via the heel string. This approach will create high pressure at the toe region of the reservoir and reduce the pressure at the heel region of the reservoir. This will also help to limit solvent short-circuiting from the heel region. Thus, it is also possible to have toe-dominant solvent injection with even steam injection.

The solvent injection rates could be intermittently reduced to zero to evaluate pressure response and restored with more solvent being injected at the toe to mitigate solvent short-circuiting at the heel.

Intentional subcool increase could be induced by slowing down the ESP speed to transition to solvent dominated toe injection and observe appropriate solvent injection rates to validate that the solvent is not being over injected and thus short-circuits without development the solvent/steam chamber which could be detrimental to the recovery scheme.

The above examples are exemplary only, and every reservoir may react differently to different injection fluids because they have a different oil profile, different porosity, different rock characteristics, etc. However, the general methodology may be applied to oil sands and other heavy or extra heavy reservoirs.

The following references are each incorporated by reference in their entireties for all purposes:

US20160153270 Solvents and non-condensable gas coinjection

US20160341021 Non-condensable gas coinjection with fishbone lateral wells

U.S. Ser. No. 10/995,596 Single well cross steam and gravity drainage (SW-XSAGD)

The invention claimed is:

1. A method for producing oil without gas interference in an electric submersible pump (ESP), said method comprising:

a) providing a well-pair having a horizontal injection well parallel to and in fluid communication with a horizontal production well, said production well fitted with an ESP at a heel of said production well, said injection well above said production well and completed with a heel-injection tube that terminates at a heel of said injection well and a toe-injection tube that terminates at a toe of said injection well;

b) injecting more solvent into said toe-injection tube than into said heel-injection tube, thereby minimizing gas interference with said ESP; and c) producing oil from said production well, wherein higher oil production rate is realized in said method than in another method that injects equivalent solvent into said toe-injection tube and said heel-injection tube.

2. The method of claim 1, said injection well completed with a mid-injection tube midway between said toe-injection tube and said heel-injection tube wherein said solvent is injected more into said toe-injection tube than said mid-injection tube, and more into said mid-injection tube than said heel-injection tube.

3. The method of claim 1, wherein said injecting step b) is co-injecting steam and said solvent.

4. The method of claim 1, wherein said solvent is a C1-C8 solvent or a non-condensable gas (NCG).

5. The method of claim 1, wherein said solvent is a C1-C5 solvent.

6. The method of claim 1, wherein said solvent is a C1-C4 solvent or C1-C2 solvent.

7. The method of claim 1, wherein said solvent is methane.

8. The method of claim 1, wherein said solvent is a non-condensable gas (NCG) selected from methane, ethane, and superheated non-condensing gas at elevated reservoir temperature solvents.

9. The method of claim 1, wherein said solvent is a NCG selected from carbon dioxide ($CO_2$), carbon monoxide (CO), nitrogen ($N_2$), methane, ethane, ethylene, nitrogen oxides (NOx), sulfur oxides ($SO_x$), flue gas, or combinations thereof.

10. A method for producing oil without gas interference in an electric submersible pump (ESP), said method comprising:

a) providing a well-pair having a horizontal injection well parallel to and in fluid communication with a horizontal production well having an ESP at a heel thereof, said injection well above and parallel to said production well and completed with a heel-injection tube that terminates at a heel of said injection well and a toe-injection tube that terminates at a toe of said injection well;

b) co-injecting more solvent and optionally steam into said toe-injection tube than into said heel-injection tube after gas locking is detected, thereby minimizing gas interference with said ESP; and c) producing oil from said production well, wherein oil is produced at a faster rate in said method than in another method that injects equivalent solvent into said toe-injection tube and said heel-injection tube after gas locking is detected.

11. The method of claim 10, said injection well completed with a mid-injection tube midway between said toe-injection tube and said heel-injection tube wherein said solvent is injected more into said toe-injection tube than said mid-injection tube, and more into said mid-injection tube than said heel-injection tube.

12. The method of claim 10, wherein said solvent is an NCG or a C1-C8 solvent.

13. The method of claim 10, wherein said solvent injection is at least 60% into said toe-injection tube.

14. The method of claim 10, wherein said solvent injection is at least 75% into said toe-injection tube.

15. The method of claim 10, wherein said solvent injection is at least 80% into said toe-injection tube.

16. The method of claim 10, wherein said solvent injection is at least 90% into said toe-injection tube.

17. The method of claim 10, wherein said solvent is co-injected with steam.

18. The method of claim 10, wherein said solvent is co-injected with steam and steam injection is evenly distributed between said toe-injection tube and said heel-injection tube or said steam injection is toe-dominant.

19. A method for producing oil without gas interference in an electric submersible pump (ESP), said method comprising:

a) providing a well-pair having a horizontal injection well parallel to and in fluid communication with a horizontal production well, said production well fitted with an electric submersible pump (ESP) at a heel of said production well, said injection well above said production well and completed with a heel-injection tube that terminates at a heel of said injection well and a toe-injection tube that terminates at a toe of said injection well;

b) injecting steam and solvent or just solvent into said heel-injection tube and said toe-injection tube, and producing oil from said production well;

c) monitoring said ESP or an oil production rate or an oil temperature or a well temperature to detect when gas interference is occurring in said ESP, and then switching to injecting more steam and solvent or just solvent into said toe-injection tube than into said heel-injection tube, thereby minimizing gas interference of said ESP; and d) producing oil from said production well, wherein oil is produced at a faster rate in said method than in another method that injects equivalent steam and solvent or just solvent into said toe-injection tube and said heel-injection tube after determining that gas interference is occurring.

* * * * *